US008519682B2

(12) United States Patent
Oates et al.

(10) Patent No.: US 8,519,682 B2
(45) Date of Patent: Aug. 27, 2013

(54) HYBRID ON-LOAD TAP CHANGER AND A METHOD OF OPERATING THE SAME

(75) Inventors: Donald Colin Murray Oates, Brocton (GB); Milan Saravolac, Levallois Perret (FR)

(73) Assignee: Alstom Grid SAS, Paris (FR)

( * ) Notice: Subject to any disclaimer, the term of this patent is extended or adjusted under 35 U.S.C. 154(b) by 754 days.

(21) Appl. No.: 12/281,235

(22) PCT Filed: Mar. 6, 2007

(86) PCT No.: PCT/EP2007/052083
§ 371 (c)(1),
(2), (4) Date: Oct. 7, 2008

(87) PCT Pub. No.: WO2007/101849
PCT Pub. Date: Sep. 13, 2007

(65) Prior Publication Data

US 2009/0230933 A1 Sep. 17, 2009

(30) Foreign Application Priority Data

Mar. 8, 2006 (GB) ..... 0604671.8

(51) Int. Cl.
*G05F 1/16* (2006.01)

(52) U.S. Cl.
USPC ..... 323/258

(58) Field of Classification Search
USPC ..... 323/305, 340–343, 255–258, 260–263, 323/209
See application file for complete search history.

(56) References Cited

U.S. PATENT DOCUMENTS

| | | | | |
|---|---|---|---|---|
| 3,619,765 | A | 11/1971 | Wood | |
| 4,151,387 | A * | 4/1979 | Peters, Jr. | 219/626 |
| 4,571,535 | A * | 2/1986 | Gyugyi | 323/211 |
| 5,604,424 | A * | 2/1997 | Shuttleworth | 323/258 |
| 6,563,723 | B2 * | 5/2003 | Nadot et al. | 363/57 |
| 2006/0039171 | A1 * | 2/2006 | Lavieville et al. | 363/19 |

FOREIGN PATENT DOCUMENTS

| | | |
|---|---|---|
| EP | 1 619 698 | 1/2006 |
| GB | 1 126 840 | 9/1968 |
| GB | 1 204 611 | 9/1970 |
| GB | 1 216 691 | 12/1970 |
| GB | 2 424 766 | 10/2006 |
| GB | 2424766 A * | 10/2006 |

* cited by examiner

*Primary Examiner* — Adolf Berhane
*Assistant Examiner* — Yemane Mehari
(74) *Attorney, Agent, or Firm* — Oblon, Spivak, McClelland, Maier & Neustadt, L.L.P.

(57) ABSTRACT

A hybrid on-load tap changer, for use in high voltage alternating current power transmission, including a selector and a diverter having two legs defining respective current paths. Each leg includes a pair of opposed first and second semiconductor switches. The hybrid on-load tap changer also includes a controller configured to switch on one of the first or second semiconductor switches of a given leg at a predetermined point within the alternating current cycle so as to commutate off a desired semiconductor switch in the other leg.

7 Claims, 12 Drawing Sheets

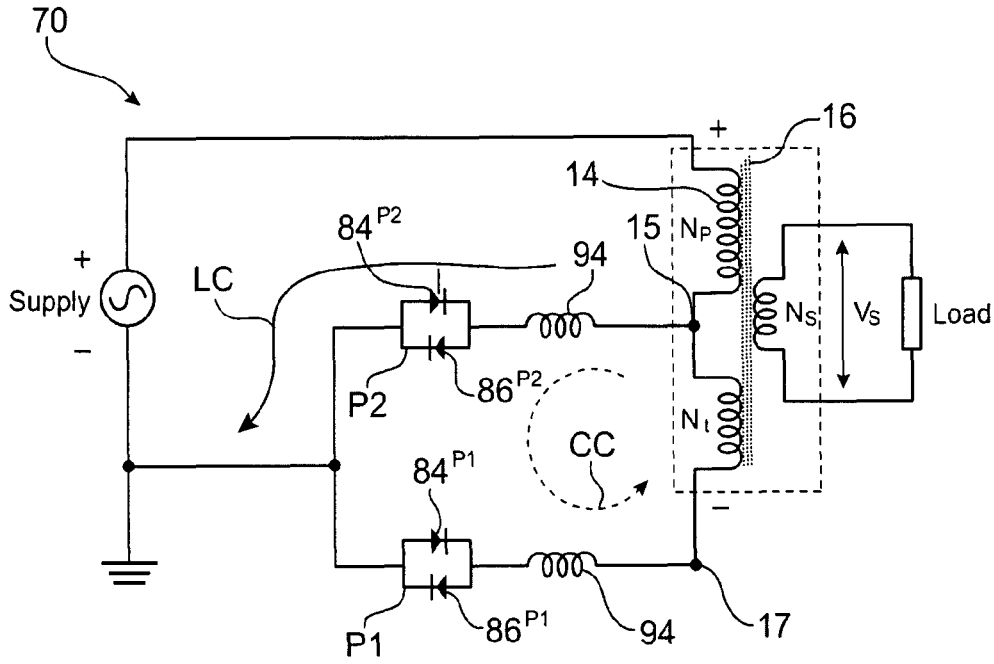
FIG.5(a)(i)
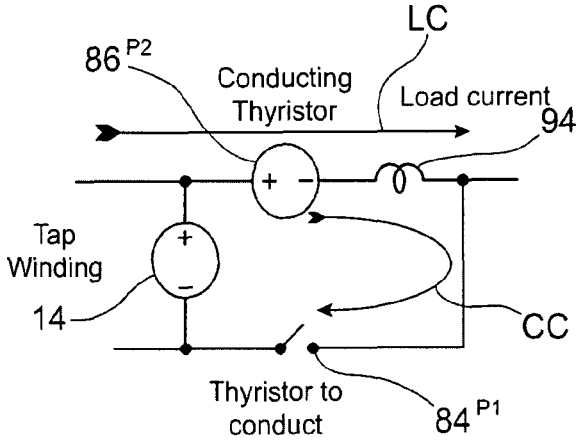
FIG.5(a)(ii)

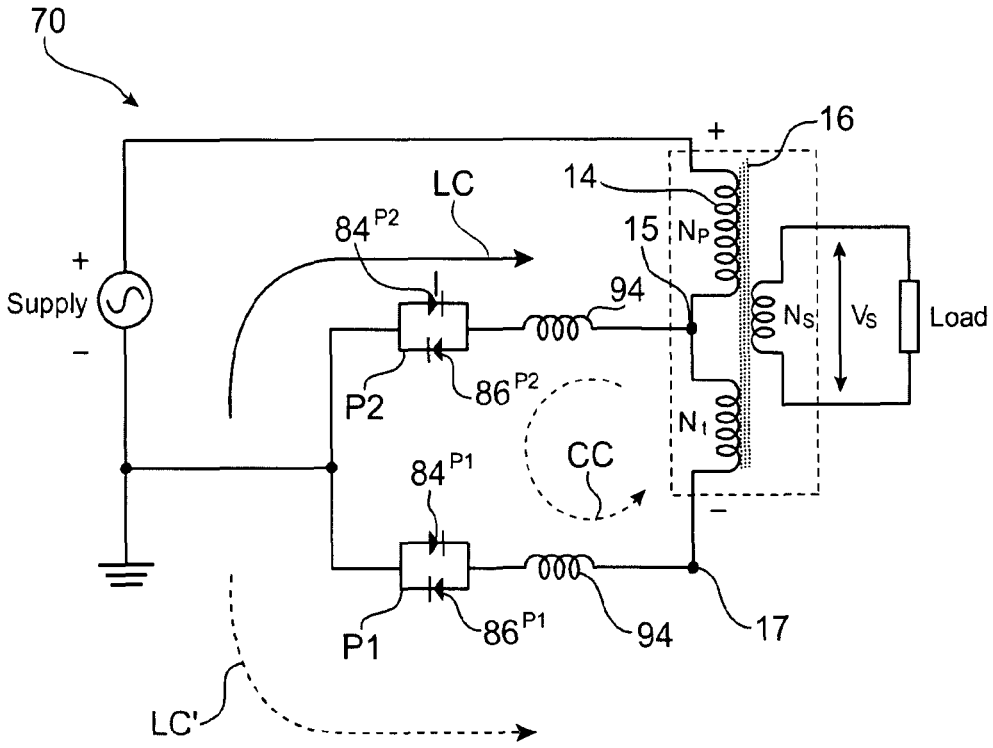
FIG.5(b)(i)
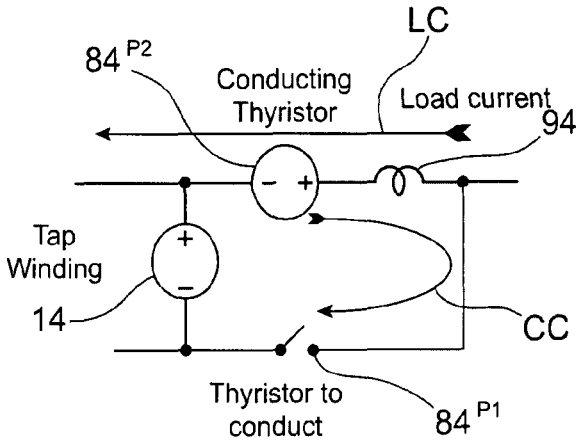
FIG.5(b)(ii)

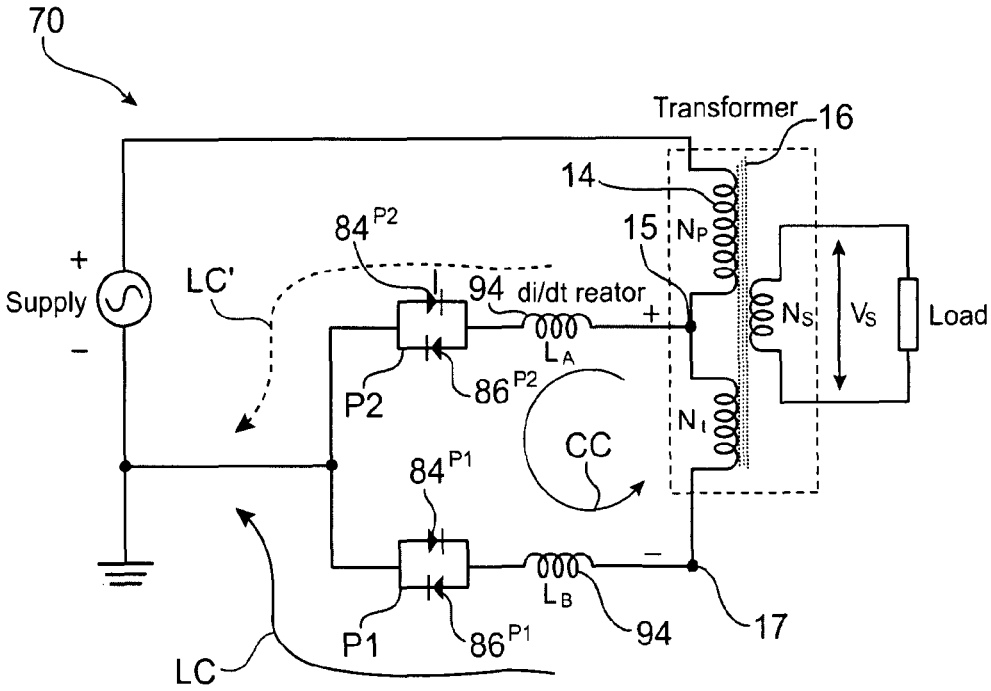
FIG.5(c)(i)
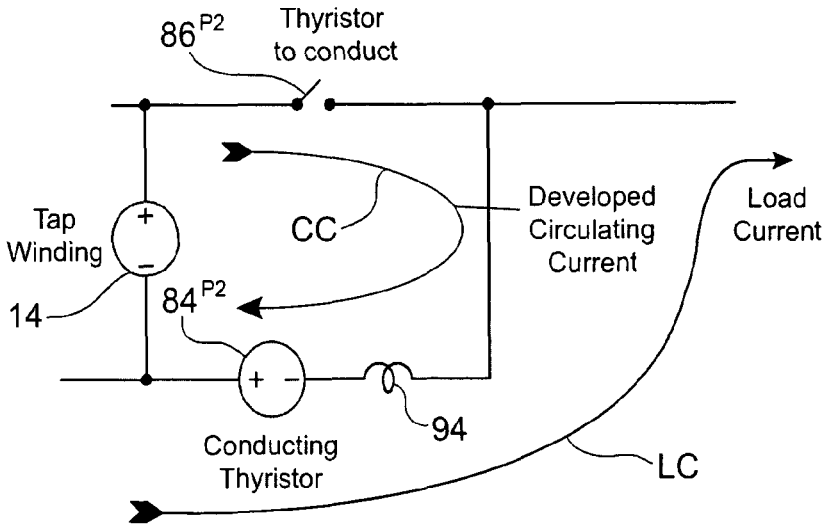
FIG.5(c)(ii)

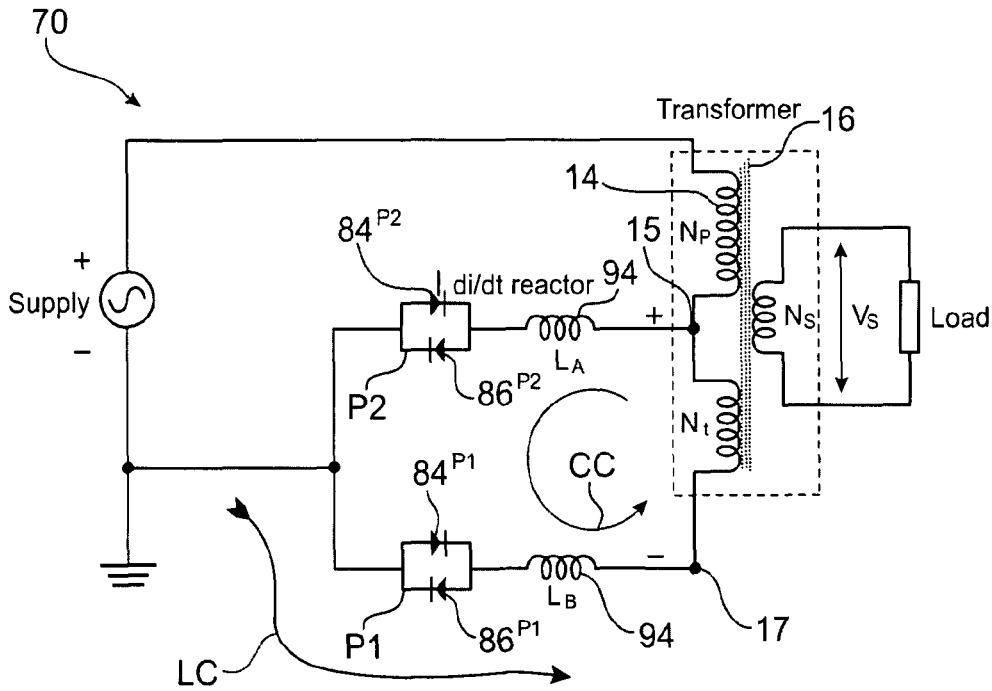
FIG.5(d)(i)
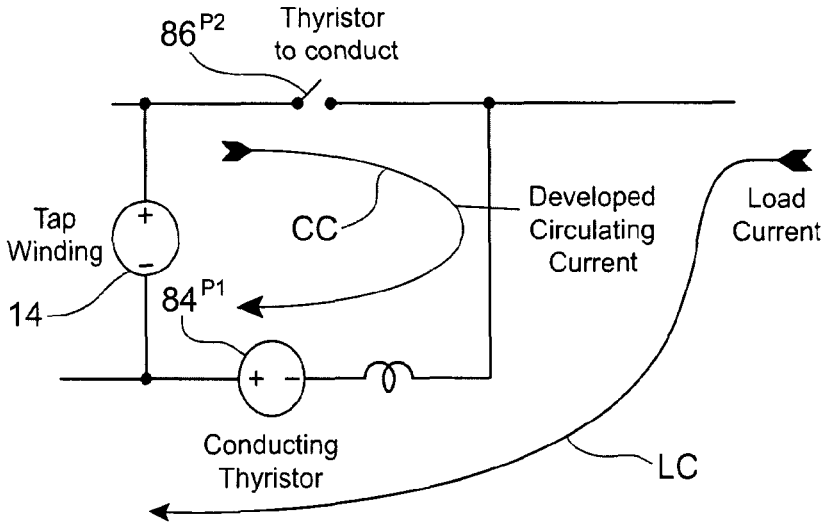
FIG.5(d)(ii)

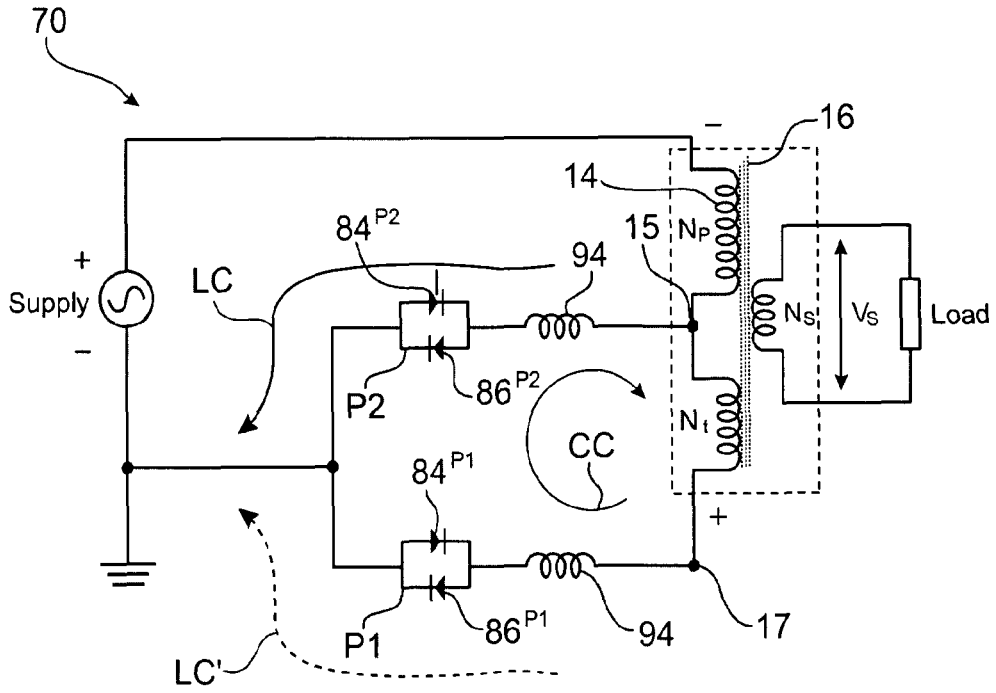
FIG.5(e)(i)
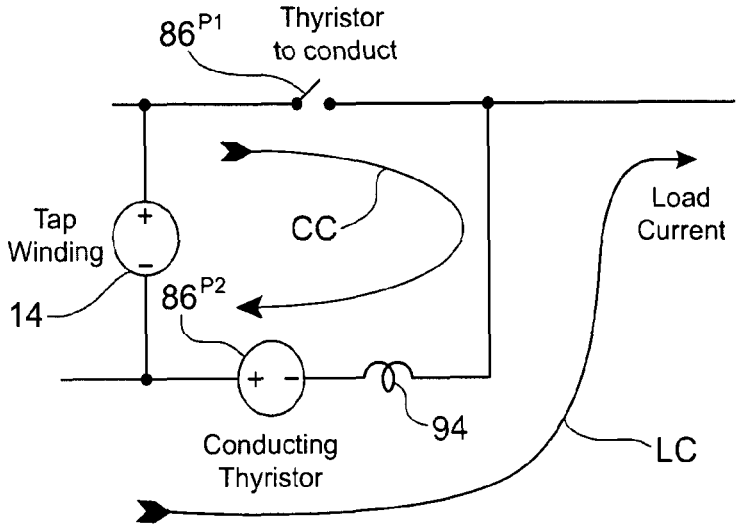
FIG.5(e)(ii)

HYBRID ON-LOAD TAP CHANGER AND A METHOD OF OPERATING THE SAME

This invention relates in particular, but not exclusively, to a hybrid on-load tap changer for use in high voltage alternating current power transmission, and a method of operating such a tap changer.

Power transmission is characterised by levels of alternating current (AC) voltage in excess of 200 kV along with high levels of surge and transient voltages and currents. These operating conditions place particular demands on the insulation requirements for the components used in such transmission.

A tap changer is a device fitted to a transformer for regulating the output voltage of the transformer to a required level. Such regulation is normally achieved by selectively connecting to a particular tap of the transformer, thereby controlling the number of turns in the active portion of the primary or secondary winding.

An on-load tap changer is designed to operate when conducting current and requires that there is no interruption to the flow of current during tap changing.

A simplified schematic of a conventional tap changer is shown in FIG. 1. The conventional tap changer 10 includes a first selector 12 and a first diverter 18 connected in series with a primary winding 14 of a transformer 16. The first selector 12 and first diverter 18 rely on oil insulation to achieve the contact-to-contact insulation levels required for the highest power transformer voltages.

The first diverter 18 has two legs 20, 22, each of which defines a respective current path, and a first electromechanical switch 24. The first electromechanical switch 24 selectively connects one leg 20 or the other 22 into the primary winding so as to selectively connect a given tap, chosen by the selector, into the primary winding 14, thereby regulating the output voltage of the transformer to a required level.

In order to avoid an interruption to the flow of current through the primary winding 14 during a tap change, the first electromechanical switch 24 has a "make before break" action, whereby the switch momentarily bridges both legs 20, 22, as shown in FIG. 1. A high level of arcing occurs when such a bridge is made or broken.

Arcing leads to a degradation of the insulating property of the insulating oil in which the first diverter 18 is placed. This results in a need to segregate oil for the first diverter from oil for the main transformer and also the need to replace the diverter oil on a regular basis.

A variant of this arrangement uses a mechanically operated vacuum switch to contain the arcing and so reduce the need for maintenance. However, the inclusion of a mechanically operated vacuum switch adds complexity, which in turn increases the capital cost of such equipment. In addition, it is necessary to replace mechanically operated vacuum switches at regular intervals.

In each of the aforementioned arrangements, the time required for each tap change is about 5 seconds of which operation of the first diverter 18 accounts for about 150 milliseconds. As a result a conventional tap changer 10 would, e.g. take more than 2 minutes and 15 seconds to carry out a step wise change over a tap range of −12 to +12.

Semiconductor switches are attractive in their ability to operate rapidly following a well defined electronic command, and to commutate off, i.e. switch off, without arcing.

The power loss and level of surge currents present in power transmission systems means that it is desirable to isolate such semiconductor switches from such systems during steady-state operation using, e.g. an electromechanical switch.

Accordingly, it is known to combine semiconductor switches with electromechanical switches to create a, so-called "hybrid" on-load tap changer, as shown in FIG. 2. Such a known hybrid on-load tap changer 30 is described, for example, in EP 1 619 698. It includes a second selector 32 and a second diverter 34 (indicated by the dashed lines) arranged in series in, e.g. the primary winding 14 of a transformer 16. The known hybrid tap changer 30 also includes a first controller 36 for controlling the operation of the second diverter 34.

The second selector 32 includes a number of taps 38, three in the example shown, and switches S1, S2, S3 for selecting a particular tap 38. The second selector 32 may also include two second electromechanical switches S4, S5 for selectively isolating a given leg of the second diverter 34, so as to bypass the semiconductor devices therein.

The second diverter 34 has two legs 40, 42 each of which defines a respective current path. Each leg 40, 42 includes a pair of opposed first and second semiconductor switches 44, 46. The semiconductor switches 44, 46 are arranged to selectively establish a current flow path in a given leg 40, 42 of the second diverter 34.

A desirable type of semiconductor switch is a thyristor 48, 50. Such devices have a high voltage and current capability, a high reliability and can operate with a junction temperature of over 150° C. In addition they are switchable by a pulse transformer, thereby omitting the need for an isolated, auxiliary power supply. Furthermore, light-triggered thyristors are available that are switchable by a pulse from a laser diode channeled through a fibre optic cable.

However, in spite of the foregoing advantages, one disadvantage of a thyristor is that it continues to conduct until the anode current is removed. This creates difficulties in commutating off such a device.

One method of commutating off a thyristor is to use, so-called "natural commutation". During natural commutation the removal of the anode current occurs naturally as a result of, e.g. fluctuation during an AC cycle in which the anode current crosses zero, i.e. is removed. Accordingly, it is possible to allow a thyristor in one leg 40, 42 to recover to a non-conducting state before switching on a thyristor in the other leg 42, 40.

However, thyristors tend to recover slowly, thereby resulting in a delay during which neither leg 40, 42 is able to provide a current flow path. As a result it is necessary to bridge the legs with bulky and expensive passive components in order to provide the necessary continuous flow of current, i.e. to avoid an interruption in the flow of current. The duration of the recovery (about 0.6 ms) is such that these passive components must be sufficiently large (and consequently bulky and expensive) to divert the current and maintain the voltage to a level within the rating of the thyristor.

A second method of commutating off a thyristor employs, so-called "resonant forced commutation". Resonant forced commutation involves taking action to remove or divert the anode current to permit the thyristor to recover to a non-conducting state.

However, such a method also requires bridging of the legs 40, 42 with bulky and expensive passive components in order to provide a continuous flow of current.

The bulk of the bridging components required in each of the above methods creates installation difficulties. Furthermore, their high cost increases the overall. cost of such a hybrid tap changer to a commercially unacceptable level.

Another type of on-load tap changer is a so-called solid-state on-load tap changer 60, as shown in FIG. 3. The solid-state tap changer 60 includes only thyristors 62 in the switching arrangement for making respective tap connections. The thyristors 62 are arranged in opposed pairs 64, 66, 68. Such tap changers are unsuitable for power transmission applications since the physical limitations of a given thyristor limits the changes in voltage and current that it is able to withstand.

In connection with the aforementioned arrangement, a proposed method of commutation involves switching on a thyristor 62 in one of the non-conducting pairs 66 so as to give rise to a circulating current CC driven by the tap voltage. In theory when the circulating current is equal in magnitude but flowing in an opposite direction to the load current LC flowing through a conducting thyristor 62, i.e. through the thyristor 62 within the conducting pair 68 that is switched on, then the respective currents CC, LC should cancel one another out such that the conducting thyristor 62 is able to commutate off. Conduction of the load current LC would be maintained by the thyristor 62 that was switched on in the originally non-conducting pair 66.

However, the arrangement shown in FIG. 3 is completely unsuitable for application in power transmission.

In power transmission applications the tap changer is fitted to the primary winding of a transformer. This is because arranging the tap changer connections in this way creates fewer insulation difficulties. In addition, such an arrangement reduces the level of current which makes the duty for existing electromechanical switching less onerous.

A solid-state tap changer of the type shown in FIG. 3 arranged in the aforementioned way would result in exposing each thyristor 62 to in excess of 40 kV. Such a voltage is beyond the practical operating specification of any known thyristor.

Therefore, it is a general aim of the invention to provide an on-load tap changer which permits the utilisation of semiconductor switching without the inherent difficulties associated with operating suitable semiconductor switches.

According to a first aspect of the invention there is provided a hybrid on-load tap changer, for use in high voltage alternating current power transmission, comprising:

a selector;

a diverter having two legs defining respective current paths, each leg including a pair of opposed first and second semiconductor switches; and a controller for selectively switching on one of the first or second semiconductor switches of a given leg at a predetermined point within the alternating current cycle so as to commutate off a desired semiconductor switch in the other leg.

The foregoing arrangement obviates the need for bulky and expensive passive bridging components, thereby reducing the capital cost of the on-load tap changer to a commercially acceptable level.

The on-load tap changer provides this advantage while facilitating the use of semiconductor switches, thereby improving the operating speed of the tap changer.

Optionally each leg further includes at least one protection element arranged in electrical communication with the pair of semiconductor switches. This allows the semiconductor switches to operate within their normal operational limits.

Preferably the protection element is or includes a snubber arranged in parallel with each pair of first and second semiconductor switches. This limits the rate of change of voltage across the semiconductor switch being commutated off, when changing a tap while supplying power to a negative power factor load.

Optionally the protection element is or includes an inductor arranged in series between the pair of first and second semiconductor switches and the selector. The inclusion of an inductor helps to limit the rise in current flowing through a given pair of first and second semiconductor switches when carrying out a tap change.

Conveniently each leg further includes a capacitor arranged so as to lie in parallel with a corresponding electromechanical isolating switch of the selector. Each capacitor limits the rate of change of voltage across the corresponding pair of semiconductor switches so as to help ensure each semiconductor switch operates within desirable operating conditions.

In a preferred embodiment of the invention each leg further includes a voltage surge arrestor arranged so as to lie in parallel with a corresponding electromechanical isolating switch of the selector. The inclusion of respective surge arrestors protects a corresponding pair of first and second semiconductor switches from a voltage surge during, e.g. a lightening strike.

Optionally the selector includes two electromechanical isolating switches for selectively isolating a respective leg of the diverter so as to by pass the semiconductor switches therein.

In another preferred embodiment of the invention each electromechanical isolating switch of the selector includes an inductor arranged in series therewith. The inductor limits the rate of change of current through respective pairs of semiconductor switches, thereby helping to ensure the said semiconductor switches operate within desirable operating conditions.

According to a second aspect of the invention there is provided a method of operating a hybrid on-load tap changer, during high voltage alternating current power transmission, comprising the steps of:

(i) providing a selector;

(ii) providing a diverter having two legs, each defining a respective current path;

(iii) providing each leg with a pair of opposed first and second semiconductor switches; and (iv) selectively switching on one of the first or second semiconductor switches of a given leg at a predetermined point within the alternating current cycle so as to commutate off a desired semiconductor switch in the other leg.

Optionally step (iii) further includes providing at least one protection element arranged in electrical communication with the pair of first and second semiconductor switches.

Preferably step (iii) includes providing a snubber arranged in parallel with each pair of first and second semiconductor switches.

Optionally step (iii) includes providing an inductor arranged in series between each pair of first and second semiconductor switches and the selector.

Conveniently the method further includes the step of providing a capacitor arranged so as to lie in parallel with a corresponding electromechanical isolating switch of the selector.

A preferred method of the invention further includes the step of providing a voltage surge arrestor arranged so as to lie in parallel with a corresponding electromechanical isolating switch of the selector. Each voltage surge arrestor protects a respective pair of first and second semiconductor switches from a voltage surge that may occur during, e.g. a lightning strike.

Another preferred method of the invention further includes the step of providing each electromechanical isolating switch of the selector with an inductor arranged in series therewith.

The method of the invention shares the advantages of the corresponding features of the apparatus of the invention.

There now follows a brief description of a preferred embodiment of the invention, by way of non-limiting example, with reference being made to the accompanying drawings in which.

Figure 6A:
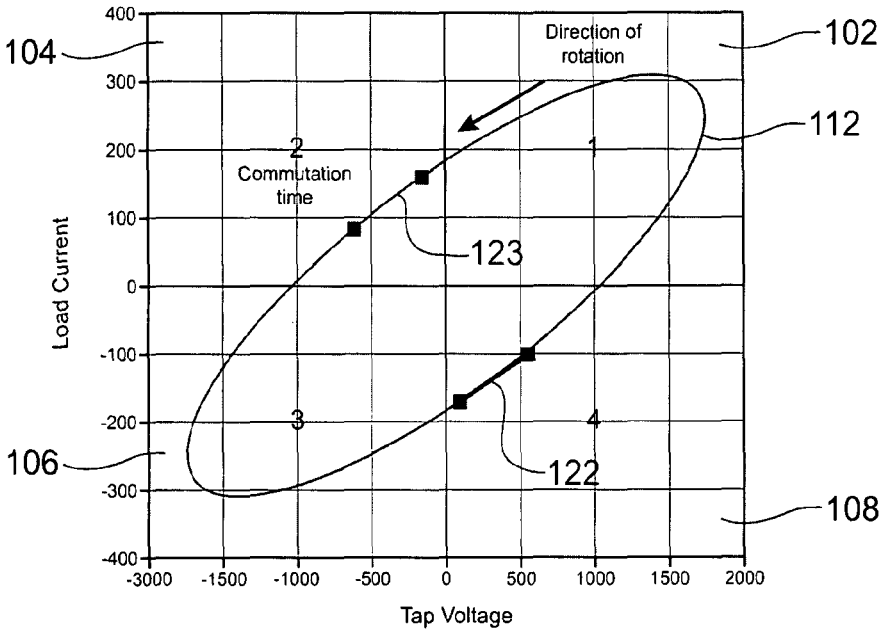
Figure 6B:
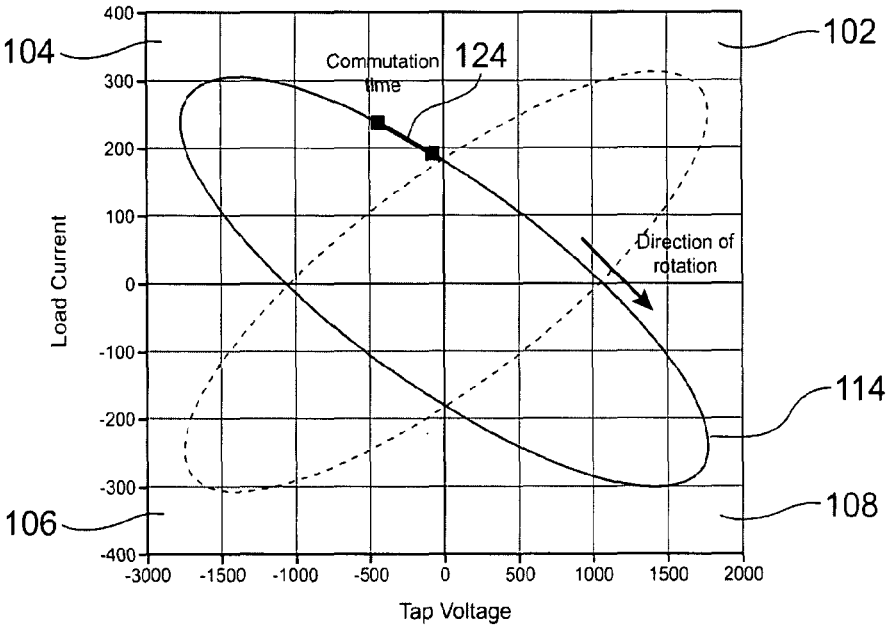
Figure 7A:
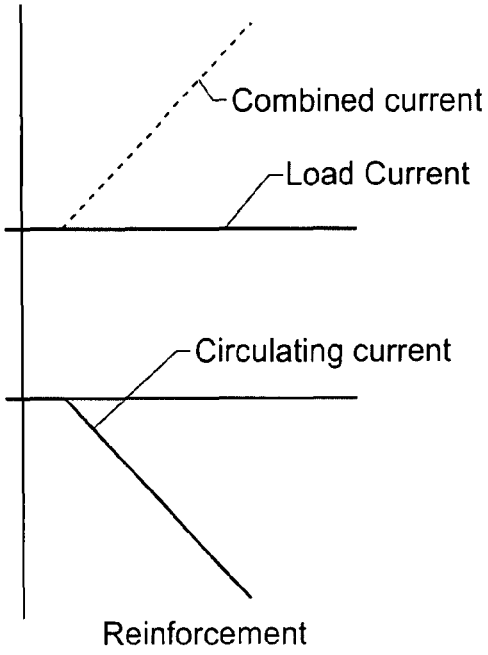
Figure 7B:
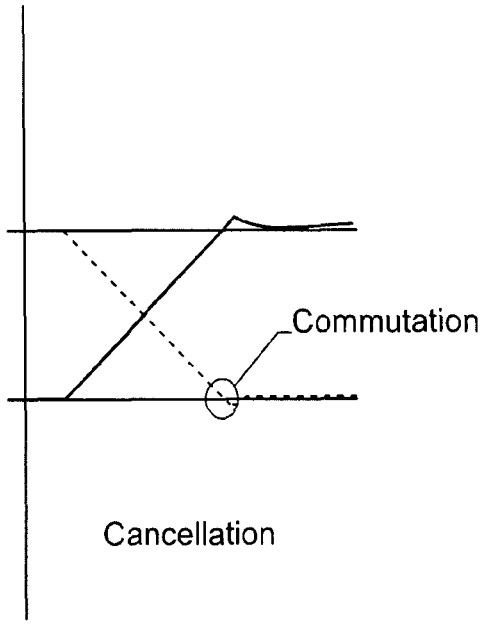
Figure 8:
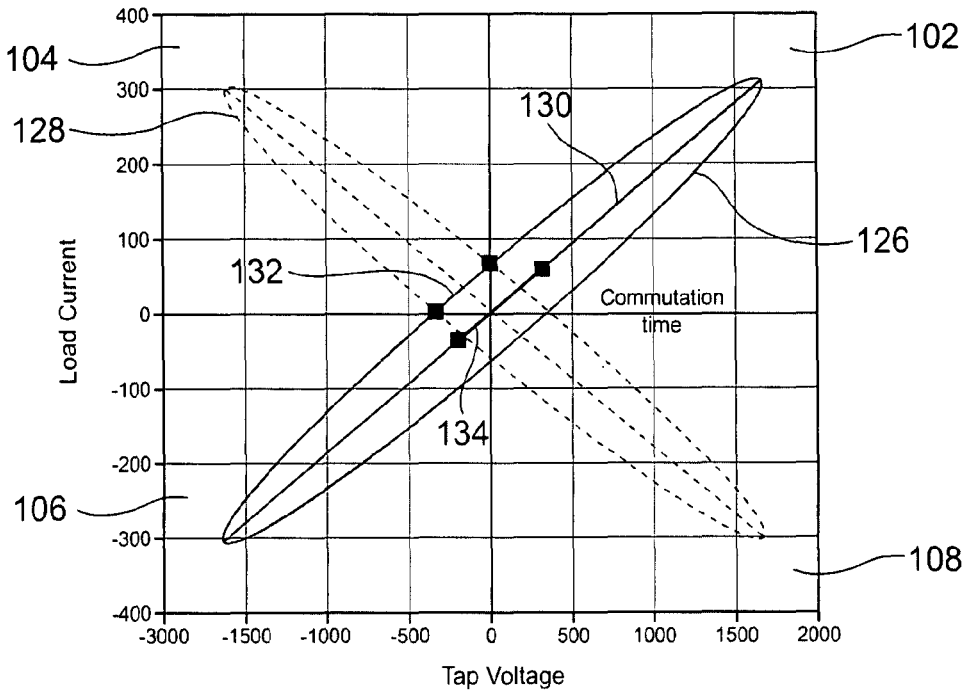

FIGS. 5(*a*)(i) to 5(*e*)(ii) show possible commutation conditions;

FIG. 6(*a*) shows a Lissajous diagram for a tap down change;

FIG. 6(*b*) shows a Lissajous diagram for a tap up change;

FIGS. 7(*a*) and 7(*b*) show respective combined effects of load current and circulating current;

FIG. 8 shows Lissajous figures for high power factor loads; and

Figure 9:
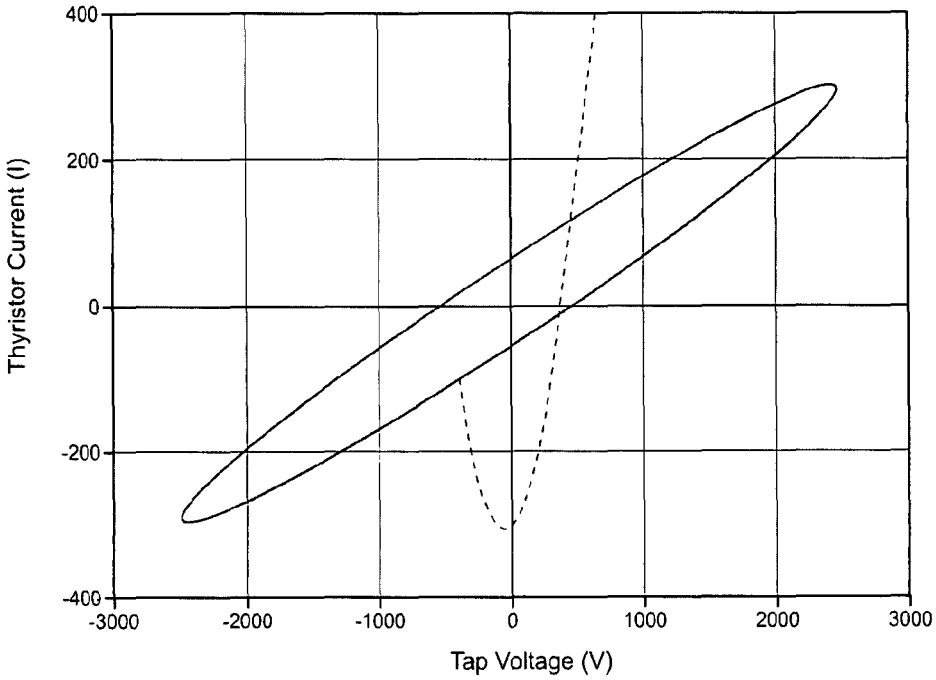

FIG. 9 shows the effect on a Lissajous figure of changing the time at which a particular non-conducting semiconductor switch is switched on.

Figure 1:
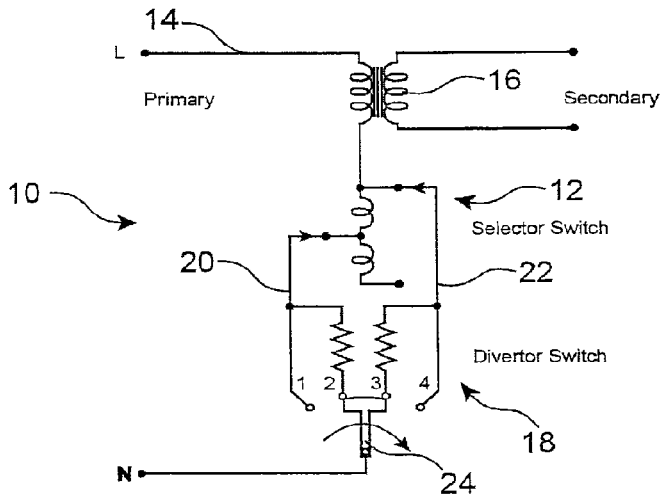
FIG.1 RELATED ART
FIG. 1 shows a schematic view of conventional on-load tap changer.
Figure 2:
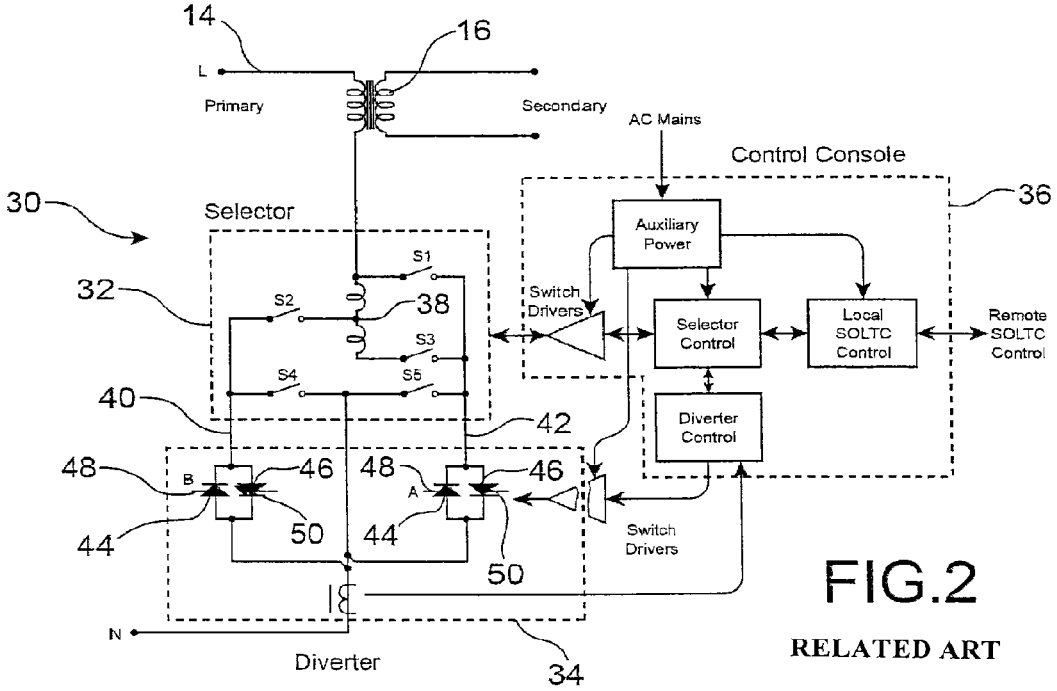
FIG.2 RELATED ART
FIG. 2 shows a schematic view of a known hybrid on-load tap changer.
Figure 3:
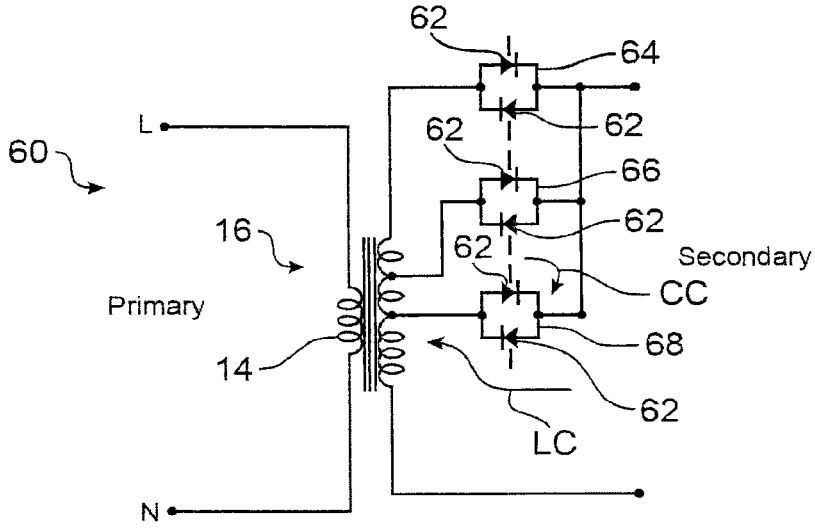
FIG.3 RELATED ART
FIG. 3 shows a known solid-state tap changer.
Figure 4:
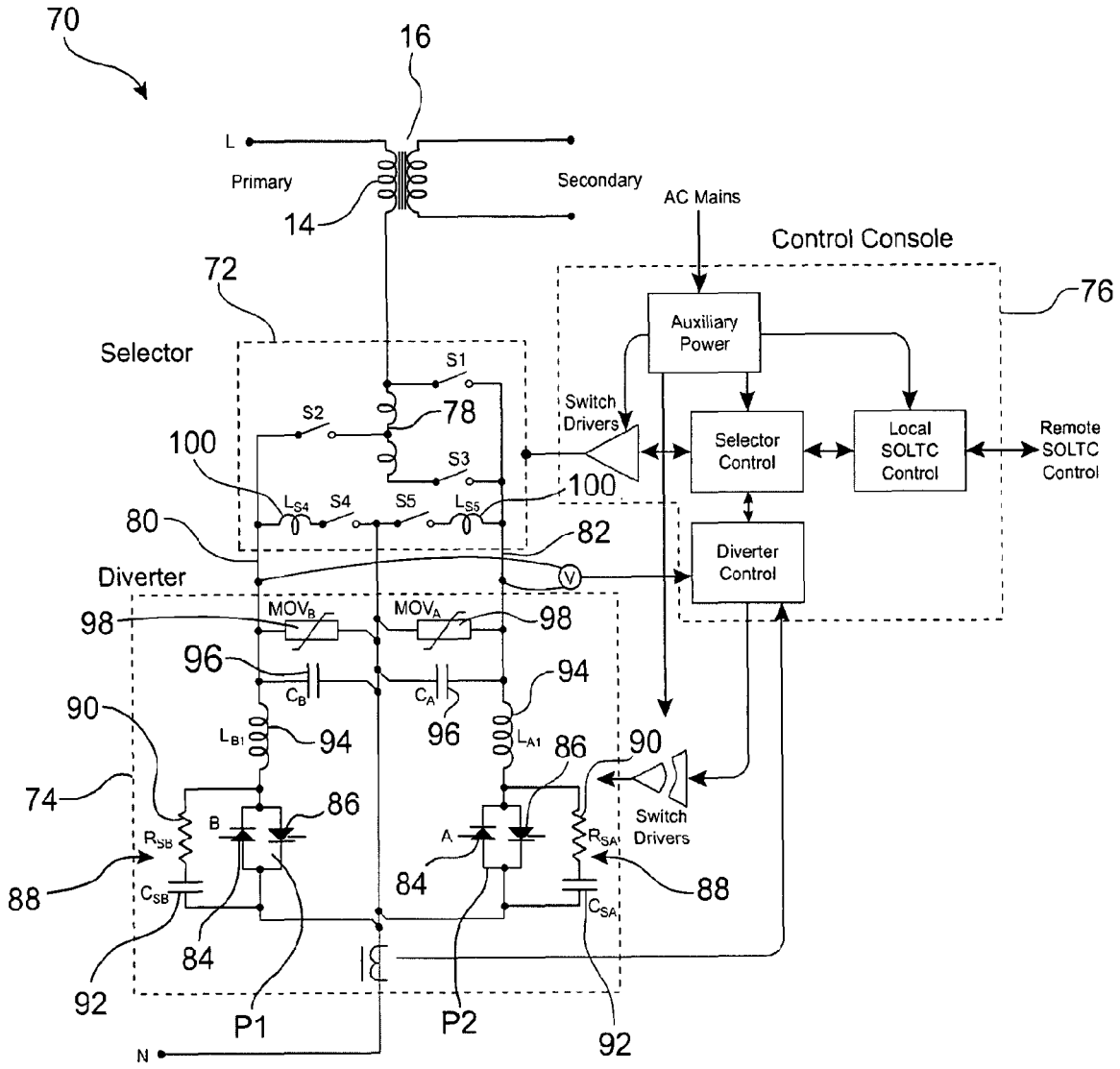
FIG. 4 shows a schematic view of a hybrid on-load tap changer according to an embodiment of the invention.

A hybrid on-load tap changer according to a first embodiment of the invention is designated generally by the reference numeral 70, as shown in FIG. 4.

The hybrid tap changer 70 includes a third selector 72, a third diverter 74 and a second controller 76. The hybrid tap changer shares some features with the known hybrid tap changer 30. Such features are designated using the same reference numerals.

The third selector 72 has a plurality of taps 78 and corresponding switches S1, S2, S3 for selecting a particular tap 78. In the example shown, three taps are included. Other embodiments of the invention may include a greater or lesser number of taps 78.

The third selector 72 also includes two second electromechanical switches S4, S5 for selectively isolating a given leg of the third diverter 74, so as to isolate the semiconductor devices therein.

The third diverter 74 has two legs 80, 82 each of which defines a respective current path. Each leg 80, 82 includes a pair P1, P2 of opposed first and second thyristors 84, 86. The thyristors 84, 86 are arranged to selectively establish a current flow path in a given leg 80, 82 of the third diverter 74. In other embodiments of the invention a different type of semiconductor switch may be used.

Each leg 80, 82 of the third diverter 74 includes a snubber 88 arranged in parallel with the pair P1, P2 of first and second thyristors 84, 86. Each snubber 88 includes a snubber resistor 90 and a snubber capacitor 92 arranged in series with one another. Each snubber 88, in use, limits the rate of change of voltage across a respective pair P1, P2 of first and second thyristors 84, 86.

Each leg 80, 82 of the third diverter 74 also includes a reactor inductor 94 arranged in series between the pair P1, P2 of first and second thyristors 84, 86 and the third selector 72. Each reactor inductor 94, in use, limits the rate of change of current flowing through a respective pair P1, P2 of first and second thyristors 84, 86.

In addition, each leg 80, 82 includes a limiting capacitor 96 arranged to lie in parallel with a corresponding second electromechanical isolating switch S4, S5 of the third selector 72. Each limiting capacitor 96, in use, helps to further limit the rate of change of voltage across a respective pair P1, P2 of first and second thyristors 84, 86.

Each leg 80, 82 of the hybrid on-load tap changer 72 embodiment shown further includes a voltage surge arrestor 98 arranged in parallel with a corresponding second electromechanical isolating switch S4, S5. In use, each voltage surge arrestor 98 protects a respective pair P1, P2 of first and second thyrsitors 84, 86 from a voltage surge during, e.g. a lightning strike.

Each second electromechanical isolating switch S4, S5 includes a selector inductor 100 arranged in series therewith. Each selector inductor 100, in use, helps to further limit the rate of change of current in a respective pair P1, P2 of first and second thyristors 84, 86.

In use, the second controller 76 selectively switches on one of the first or second thyristors 84, 86 of a given, non-conducting pair P1, P2 in a given leg 80, 82 at a predetermined point within the alternating current cycle so as to commutate off a desired conducting thyristor 84, 86 of the other pair P1, P2 in the other leg 80, 82.

Such switching allows the number of turns on the primary winding 14 to be increased or decreased, as required, without interrupting the flow of load current LC.

In the third diverter 74 circuit shown, increasing the number of turns on the primary winding carries out a tap down change while decreasing the number of turns carries out a tap up change.

Four distinct tap voltage and load current LC conditions occur within the third diverter 74 circuit shown in FIG. 4 during one half of a given AC cycle, e.g. when the supply voltage is positive. The four conditions are: (i) both the tap voltage and the load current LC being positive; (ii) the tap voltage being negative and the load current LC being positive; (iii) both the tap voltage and the load current LC being negative; and (iv) the tap voltage being positive and the load current LC being negative.

Since the two halves of an AC cycle (i.e. when the supply voltage is positive and negative, respectively) are symmetrical, the further four tap voltage and load current LC conditions for the second, negative, half-cycle are essentially duplicates of the first four conditions.

In addition, when back generation takes place, i.e. when the load regenerates power, another four tap voltage and load current LC conditions arise. Each of these corresponds to one of the four distinct tap voltage and load current LC conditions outlined above.

FIG. 5(*a*)(i) illustrates the first tap voltage and load current LC condition. The second thyristor of the second pair $\mathbf{86}^{P2}$ is initially conducting, i.e. switched on and load current LC is being sourced, i.e. is coming out of the transformer primary winding 14 and so is considered positive.

The supply voltage is positive so the first tap winding 15 which is connected through the second thyristor of the second pair $\mathbf{86}^{P2}$ is positive with respect to the second tap winding 17 which it is desired to switch to. Accordingly, the tap voltage is considered positive in this condition.

FIG. 5(*a*)(ii) shows a simplified schematic of the conditions shown in FIG. 5(*a*)(i).

FIGS. 5(*b*)(i) and 5(*b*)(ii) illustrate the second condition. Load current LC is being regenerated, i.e. it is flowing into the primary winding 14, and so is considered negative. The first tap winding 15 is positive with respect to the second tap winding 17 which it is desired to switch to. Accordingly, the tap voltage is considered positive.

FIGS. 5(*c*)(i) and 5(*c*)(ii) illustrate the third condition. Load current LC is being sourced from the primary winding 14 so is considered positive. The second tap winding 17 is negative with respect to the first tap winding 15 which it is desired to switch to. Accordingly, the tap voltage is considered negative.

FIGS. 5(*d*)(i) and 5(*d*)(ii) illustrate the fourth condition. Load current LC is being regenerated so is considered negative. The second tap winding 17 is negative with respect to the first tap winding 15 which it is desired to switch to, so the tap voltage is also negative.

It is possible to represent the relationship between the tap voltage and load current LC at any particular instant in a given AC cycle of a power transmission system on a Lissajous diagram, as shown in FIGS. 6(*a*) and 6(*b*).

Each Lissajous diagram includes a first, second, third and fourth quadrant 102, 104, 106, 108 corresponding to respective tap voltage and load current LC conditions.

The tap voltage and load current LC conditions in each of the first to fourth conditions correspond to those in a respective quadrant 102, 104, 106, 108. Accordingly, it is possible to map each of the first to fourth conditions on a Lissajous diagram.

A first Lissajous diagram 112 (FIG. 6(*a*)) is for a tap down change, i.e. reducing the voltage in the transformer secondary winding by switching the tap connection so as to increase the number of turns in the primary winding 14.

For an inductive load (as illustrated), the relationship between tap voltage and load current LC varies with time along the locus of the first Lissajous diagram 112 in an anti-clockwise direction.

A capacitive load (not illustrated) would cause the relationship between tap voltage and load current LC to vary with time along the locus of the first Lissajous diagram 112 in a clockwise direction.

A second Lissajous diagram 114 (FIG. 6(*b*)) illustrates the relationship between tap voltage and load current LC in the third diverter circuit 74 when carrying out a tap up change, i.e. when decreasing the number of turns in the primary winding 14.

The second Lissajous diagram 114 is a mirror image of the first Lissajous diagram 112, about the vertical, zero tap voltage axis.

For an inductive load (as illustrated) the relationship between tap voltage and load current varies with time along the second Lissajous figure 114 in a clockwise direction.

A capacitive load (not illustrated) would cause the relationship between tap voltage and load current LC to vary with time along the locus of the second Lissajous diagram 114 in an anti-clockwise direction.

The locus of each Lissajous diagram 112, 114 traverses each quadrant regardless of whether the tap change is down or up. The nature of the tap change merely determines the amount of time the locus of each Lissajous diagram 112, 114 remains in a particular quadrant.

Since the first and second conditions (FIGS. 5(*a*) and 5(*b*)) are for a tap down change they correspond to the first Lissajous diagram 112.

In the first condition both the load current and the tap voltage are positive so it corresponds to the first quadrant 102 of the first Lissajous diagram 112. In the second condition the load current is negative and the tap voltage is positive so it corresponds to the fourth quadrant 108 of the first Lissajous diagram 112.

Since the third and fourth conditions (FIGS. 5(*c*) and 5(*d*)) are for a tap up change they correspond to the second Lissajous diagram 114.

In the third condition the load current is positive and the tap voltage is negative so it corresponds to the second quadrant 104 of the second Lissajous diagram 114. In the fourth condition both the load current and the tap voltage are negative so it corresponds to the third quadrant 106 of the second Lissajous diagram 114.

The voltage polarity of the primary winding 14 in each of FIGS. 5(*a*) to 5(*d*) is set by the supply voltage which is positive during the half-cycle considered.

In each of FIGS. 5(*a*) and 5(*b*), one thyristor $\mathbf{84}^{P2}$, $\mathbf{86}^{P2}$ of the second pair P2 is initially conducting while each of the other thyristors $\mathbf{84}^{P1}$, $\mathbf{86}^{P1}$ of the first pair P1 is switchable on so as to conduct, i.e. is initially non-conducting. Consequently the tap voltage is positive. This, in combination with whether load current LC is being sourced or regenerated, i.e. is either positive or negative, determines whether commutation is possible.

For example, for the conditions illustrated in FIGS. 5(*a*)(i) and (ii) (i.e. the load current is positive and the tap voltage is positive), switching on the first non-conducting thyristor $\mathbf{84}^{P1}$ of the first pair P1 causes a circulating current CC driven by the voltage polarity of the primary winding 14, to flow in the circuit.

The circulating current CC reinforces the load current LC to give an increased overall, combined current, as shown in FIG. 7(*a*).

For the conditions illustrated in FIGS. 5(*b*)(i) and (ii), switching on the first non-conducting thyristor $\mathbf{84}^{P1}$ of the first pair P1 causes a circulating current CC, driven by the voltage polarity of the primary winding 14, to flow in the circuit.

The circulating current CC cancels the load current LC, as shown in FIG. 7(*b*), thereby allowing the conducting thyristor (in this instance the first conducting thyristor $\mathbf{84}^{P2}$ of the second pair P2) to commutate off.

Meanwhile, the newly switched on thyristor (the first thyristor $\mathbf{84}^{P1}$ of the first pair P1) is able to conduct the main load current, i.e. the first thristor $\mathbf{84}^{P1}$ of the first pair P1 defines a new flow path for the load current, as shown by dashed line LC' in FIG. 5(*b*)(i). In this way load current flow is maintained while increasing the number of turns on the primary winding 14, i.e. while carrying out a tap change.

In each of FIGS. 5(*c*) and 5(*d*), one thyristor $\mathbf{84}^{P1}$, $\mathbf{86}^{P1}$ of the first pair P1 is initially conducting while each of the other thyristors $\mathbf{84}^{P2}$, $\mathbf{86}^{P2}$ of the second pair P2 is switchable on so as to conduct, i.e. is initially non-conducting. Consequently the tap voltage is negative. This, in combination with whether load current LC is being sourced or regenerated, i.e. is either positive or negative, determines whether commutation is possible.

For example, for the conditions illustrated in FIGS. 5(*c*)(i) and (ii), switching on the second non-conducting thyristor $\mathbf{86}^{P2}$ of the second pair P2 causes a circulating current CC driven by the voltage polarity of the primary winding 14, to flow in the circuit.

The circulating current CC cancels the load current LC, thereby allowing the conducting thyristor (in this instance the second conducting thyristor $\mathbf{86}^{P1}$ of the first pair P1) to commutate off.

For the conditions illustrated in FIGS. 5(*d*)(i) and (ii), switching on the second non-conducting thyristor $\mathbf{86}^{P2}$ of the second pair P2 causes a circulating current CC driven by the voltage polarity of the primary winding 14, to flow in the circuit.

The circulating current CC reinforces the load current LC to give an increased overall, combined current.

Accordingly, in order to commutate off a desired conducting thyristor $\mathbf{84}^{P2}$, $\mathbf{86}^{P1}$ it is necessary to switch on a particular non-conducting thyristor $\mathbf{84}^{P1}$, $\mathbf{86}^{P2}$ when the tap voltage and load current conditions correspond to a particular condition, i.e. those in the fourth quadrant 108 of the first Lissajous diagram 112; and those in the second quadrant 104 of the second Lissajous diagram 114.

As a result, it is necessary to control when during the AC cycle a particular non-conducting thyristor $\mathbf{84}^{P1}$, $\mathbf{86}^{P2}$ is switched on. This is in order to ensure that there is sufficient time to complete commutation off of a particular conducting thyristor $\mathbf{84}^{P2}$, $\mathbf{86}^{P1}$ while the load current and tap voltage of the power transmission system correspond to the conditions in the second or fourth 104, 108 quadrants.

The particular instant in each of the second and fourth 104, 108 quadrants at which the particular non-conducting thyristor $\mathbf{84}^{P1}$, $\mathbf{86}^{P2}$ is switched on is chosen in order to minimise the rate of change of current and voltage experienced by the thyristors of each pair P1, P2.

For example, it is desirable to switch on the particular non-conducting thyristor $\mathbf{84}^{P1}$, $\mathbf{86}^{P2}$ while the tap voltage is low so as to limit the rise in current experienced by the respective thyristor pairs P1, P2.

When carrying out a tap down change (FIGS. 5(*a*) and 5(*b*)) a first time period 122, during which it is desirable to commutate off a particular conducting thyristor $\mathbf{84}^{P2}$ is shown on the locus of the first Liassajous diagram 112 (FIG. 6(*a*)).

This period is chosen so as to limit the rate of change of current experienced by each pair of thyristors P1, P2 during commutation.

Limiting the rate of change of current during commutation reduces the size of reactor inductor 94 required, and hence the cost of such an inductor. A low rate of change of current occurs adjacent to the zero tap voltage axis.

Accordingly, by switching on the second non-conducting thyristor $\mathbf{86}^{P1}$ of the first pair P1 when the AC cycle is adjacent to the zero tap voltage axis, it is possible to limit the rate of change of current experienced by each pair of thyristors P1, P2 to within the physical operating parameters of each thyristor $\mathbf{84}^{P1}$, $\mathbf{86}^{P1}$, $\mathbf{84}^{P2}$, $\mathbf{86}^{P2}$, using only a moderately sized and less expensive reactor inductor 94.

When carrying out a tap up change (FIGS. 5(*c*) and 5(*d*)) it is desirable to commutate off the conducting thyristor $\mathbf{86}^{P1}$ during a second time period 124, as shown on the locus of the second Lissajous diagram 114 of FIG. 6(*b*).

In order to limit the rate of change of current experienced by each pair of thyristors P1, P2 during commutation it is desirable for commutation to take place while the tap voltage is low, i.e. adjacent to the zero tap voltage axis. However, for commutation to take place within a desired quadrant, e.g. the second quadrant 104 of the second Lissajous diagram 114, it must occur before the tap voltage reaches zero volts.

As a result, there is a high rate of change of voltage across each pair of thyristors P1, P2.

In order to limit the degree to which each pair of thyristors P1, P2 experience this rate of change of voltage, it is desirable to include a snubber 88 in parallel with each pair of thyristors P1, P2.

The symmetry of each half of the AC cycle means that when carrying out a tap down change it is also possible to commutate off the conducting thyristor $\mathbf{86}^{P2}$ during the second, negative half-cycle, as shown in FIGS. 5(*e*)(i) and (ii).

The load current and tap voltage conditions during this period correspond to those in the second quadrant 104 of the first Lissajous diagram 112 (FIG. 6(*a*)). A third time period 123 during which it is desirable to commutate off the conducting thyristor $\mathbf{86}^{P2}$ is shown on the locus of the first Lissajous diagram 112.

Similarly, when carrying out a tap up change it is also possible to commutate off the conducting thyristor during the second, negative, half-cycle.

The load current and tap voltage conditions during this period correspond to those in the fourth quadrant 108 of the second Lissajous diagram 114 (FIG. 6(*b*).

Accordingly, it is possible to commutate off a respective conducting thyristor during each half cycle, i.e. one conducting thyristor in each of the second and fourth quadrants 104, 108. This means that switching of the third diverter could take place twice during each AC cycle.

Therefore, it is possible to carry out two tap changes during each AC cycle, subject to the selecting performance, i.e. the time required to select a particular tap, of the third selector 72.

When switching on a non-conducting thyristor as outlined above, it is necessary for the load current and tap voltage conditions of the power transmission system to remain within the desired quadrant 104, 108 for a sufficient time to allow commutation to take place. The minimum time required in a desired quadrant 104, 108 is determined by the time taken for a given conducting thyristor to commutate off, i.e. recover to a non-conducting condition. Typically this is about 650 μs.

This places a restriction on the phase relationship between the load current and tap voltage, or the so-called "power factor" of the system.

FIG. 8 shows fourth to sixth Lissajous figures 126, 128, 130.

The fourth and fifth Lissajous figures 126, 128 are for +0.98 and −0.98 phase relationships between load current and tap voltage. The + and − signs refer to tap down and tap up changes, respectively.

The period of time that the locus of, e.g. the fourth Lissajous figure 126 is in the second quadrant 104, as indicated by a fourth time period 132, is 650 μs. Accordingly, a +/−0.98 power factor load is the highest power factor which allows commutation to take place wholly within a desired quadrant 104, 108.

Greater phase relationships between load current and tap voltage, i.e. higher power factors, result in an increasingly narrow Lissajous figure which spends less than 650 μs in a desired quadrant 104, 108, as shown by the sixth Lissajous figure 130 which is for a unity, i.e. +1.0, power factor load.

This limitation in the phase relationship can be overcome by switching on the non-conducting thyristor, i.e. initiating commutation, before crossing the zero tap voltage axis and before entering the third quadrant 106, as indicated by a fifth time period 134.

Preferably such switching occurs approximately half the thyristor recovery time, i.e. 325 μs before crossing the zero tap voltage axis.

During such a mode of operation the reactor inductor 94, the self inductance of the transformer and the switching of the voltage polarity of the primary winding 14 (i.e. the tap voltage) as the supply voltage inverts, all help to limit the rise in current resulting from the short circuit created.

When carrying out a tap down change, switching of the tap voltage on crossing the zero tap voltage axis creates the condition illustrated in FIG. 5(*e*). This generates a circulating current CC which cancels the load current LC, thereby allowing the conducting thyristor $\mathbf{86}^{P2}$ to commutate off.

Switching on the non-conducting thyristor $\mathbf{86}^{P1}$ before crossing the zero tap voltage axis shifts the Lissajous figure (as shown in FIG. 9) so as to change the point at which the locus thereof enters a desired quadrant 104, 108 (in this case the fourth quadrant 108) in order to provide sufficient time within the desired quadrant 108 for commutation to take place.

The invention claimed is:

1. A hybrid on-load tap changer, for use in high voltage alternating current power transmission, comprising:

a selector including two electromechanical isolating switches;

a diverter including two legs defining respective current paths, each leg including a pair of opposed first and second semiconductor switches, each leg including a first inductor arranged in series between each pair of first and second semiconductor switches and the selector, and each leg including a voltage surge arrestor in parallel with each of the electromechanical isolating switches of the selector;

a controller configured to switch on one of the first or second semiconductor switches of a given leg at a predetermined point within the alternating current cycle so as to commutate off a desired semiconductor switch in the other leg; and a snubber arranged in parallel with each pair of first and second semiconductor switches, wherein each of the electromechanical isolating switches includes a second inductor arranged in series therewith, each of the second inductors being arranged in series with the respective first inductors, and each of the electromechanical isolating switches and the respective second inductors being arranged in parallel with the corresponding voltage surge arrestor of each leg.

2. The hybrid on-load tap changer according to claim 1, wherein each leg further includes a capacitor in parallel with a corresponding each of the electromechanical isolating switches of the selector.

3. The hybrid on-load tap changer according to claim 1, wherein the two electromechanical isolating switches selectively isolate a respective leg of the diverter so as to bypass the semiconductor switches therein.

4. A method of operating a hybrid on-load tap changer, during high voltage alternating current power transmission, comprising:

(i) providing a selector including two electromechanical isolating switches;

(ii) providing a diverter including two legs, each defining a respective current path;

(iii) providing each leg with a pair of opposed first and second semiconductor switches, providing a first inductor arranged in each leg in series between each pair of first and second semiconductor switches and the selector, and providing each leg with a voltage surge arrestor in parallel with each of the electromechanical isolating switches of the selector;

(iv) selectively switching on one of the first or second semiconductor switches of a given leg at a predetermined point within the alternating current cycle so as to commutate off a desired semiconductor switched in the other leg; and (v) providing each of the electromechanical isolating switches with a second inductor arranged in series therewith, each of the second inductors being arranged in series with the respective first inductors, and each of the electromechanical isolating switches and the respective second inductor being arranged in parallel with the corresponding voltage surge arrestor of each leg, wherein the predetermined point at which the semiconductor switches are operated is just prior to zero voltage appearing across tap terminals.

5. The method of operating a hybrid on-load tap changer according to claim 4, further comprising (vi) providing a capacitor in parallel with a corresponding each of the electromechanical isolating switches of the selector.

6. The hybrid on-load tap changer according to claim 1, wherein each of the second inductors are arranged to be directly connected to the respective first inductors, when the corresponding electromechanical isolating switches are on.

7. The hybrid on-load tap changer according to claim 1, wherein each leg further includes a capacitor in parallel with a corresponding each of the electromechanical isolating switches of the selector, each capacitor being in parallel with the respective voltage surge arrestors and the respective second inductors.

* * * * *